United States Patent [19]

Burden, Jr.

[11] 4,108,088

[45] Aug. 22, 1978

[54] ROTARY INCINERATOR

[75] Inventor: Roy B. Burden, Jr., Makaha, Hi.

[73] Assignee: Met-Pro Systems, Inc., Lansdale, Pa.

[21] Appl. No.: 744,591

[22] Filed: Nov. 24, 1976

[51] Int. Cl.[2] ..... F23G 5/06

[52] U.S. Cl. ..... 110/246; 432/118; 110/258

[58] Field of Search ..... 110/14, 15; 432/105, 432/108, 118

[56] References Cited

U.S. PATENT DOCUMENTS

| | | | |
|---|---|---|---|
| 2,088,225 | 7/1937 | Allen et al. | 110/14 |
| 3,626,875 | 12/1971 | Cleares | 110/14 |
| 3,705,711 | 12/1972 | Seelandt | 110/14 |
| 3,794,565 | 2/1974 | Bielski et al. | 110/14 |
| 3,916,807 | 11/1975 | Eiki | 110/14 |

*Primary Examiner*—Kenneth W. Sprague

*Attorney, Agent, or Firm*—Woodcock, Washburn, Kurtz & Mackiewicz

[57] ABSTRACT

An incinerator or dryer for sewage sludge and the like includes a horizontal rotating combustion chamber with a protruding internal helical conveyor. The wet sludge enters at one end and dry ash is discharged from the other end. Heat scavenging devices include lengths of chain having ends which are secured to the helical conveyor. These chains dip into the wet sludge when the drum rotates. As the drum rotates further, the chains move to a hanging position exposing the wet sludge to the combustion gas stream which flows through the drum. The dry ash lies in the bottom of the drum and is transported by the helical conveyor to an ash wheel at the opposite end of the drum. This wheel separates the ash from the combustion gases by rotating a series of ash holding plates which pick up the ash at the bottom of the drum and discharge it at the top of the rotation of the ash wheel.

10 Claims, 7 Drawing Figures

ROTARY INCINERATOR

BACKGROUND OF THE INVENTION

This invention relates to material treatment apparatus and more particularly to a substantially horizontal, rotating auxiliary fired combustion incinerator.

Combustion incinerators are used to burn slurries of material containing organic contaminants. Examples of wastes which can be disposed of in this manner include sewage sludge, ship ballast and insecticide residues. There are numerous other applications such as regenerating activated carbon and chemical processes wherein it is desired to dry, burn or otherwise process a wet material.

Environmental protection regulations are particularly stringent about the discharge of gaseous and particulate material into the atmosphere. For this reason, it is necessary to provide an incinerator which separates the combustion gases which escape into the atmosphere from the dry ash which is collected and transported to another location for disposal or for use.

Construction costs and low cost maintenance are important considerations. Heretofore, incinerators for relatively low flow applications could not meet the required clean air requirements at installation and maintenance costs which are economically feasible.

SUMMARY OF THE INVENTION

In accordance with this invention, a substantially horizontal rotating chamber has a protruding helical conveyor formed of flights which move combustible material from one end where the wet material enters to the other end where dry ash and combustion gases are separated and removed. Heat scavenging devices made up of flexible elongated members, such as chains, are secured to the flight and perform two functions. The chains induce drying or incineration of the sludge and the chains also block movement of the wet sludge through the rotating drum so that only ash or dry materials that have been processed are discharged from the other end. The rotating drum is horizontal and this also slows the movement of the sludge through the drum in contrast to state of the art kilns which are inclined. The chains of the present invention pick up wet sludge when they are at the bottom of the drum and, as the drum rotates, the chains fall to a hanging position which exposes the wet sludge thereon to the combustion gas stream flowing through the middle of the drum, thereby drying the sludge. Also the chains scavenge heat from the gas stream and the transfer of this heat to the sludge aids in drying it. The mass and thermal conductivity of the chains can be selected to best burn the sludge being treated.

The retention of accurately controlled volumes of sludge within the incinerator is an important feature of the invention. The flights projecting toward the center of the rotating drum each accumulate a small volume of wet or partly dried sludge. The total of these volumes is greater than the total volume of sludge that could be retained within furnaces such as rotary hearth or fluidized bed systems. This larger volume of sludge absorbs more heat during a given period of time and results in lower fuel consumption. The inward projection pitch or distance between the flights can be varied so as to vary the total volume of sludge within the rotary chamber at a given time.

In accordance with another feature of the invention, an ash wheel separates the dry ash from the combustion gases. The ash wheel delivers the ash to a screw conveyor which provides an air lock for the ash removal chamber so that no combustion gases escape from this chamber. The combustion gases are delivered to a stack, or to an after burner and thence to a stack for discharge, or to a products of combustion scrubber, or other non-combustible particulate removal device.

In accordance with this invention, a rotary incinerator having good gas/ash separation is provided at an economical construction cost and low maintenance costs. An important contribution to low maintenance costs is that the incinerator has no moving parts in the hot part of the furnace.

Another important improvement over the prior art is the manner in which the ash is removed without the need for operator intervention.

Another advantage of this invention is that relatively low combustion gas velocities can be used as compared to fluidized bed systems, for example, which require substantial air volumes in order to achieve bed fluidization. Low gas velocities achieve low particulate discharge.

The foregoing and other objects, features and advantages of the invention will be better understood from the following more detailed description and appended claims.

DESCRIPTION OF THE DRAWINGS

FIG. 3 is an end view of the ash wheel;

DESCRIPTION OF THE PREFERRED EMBODIMENT

Figure 1:
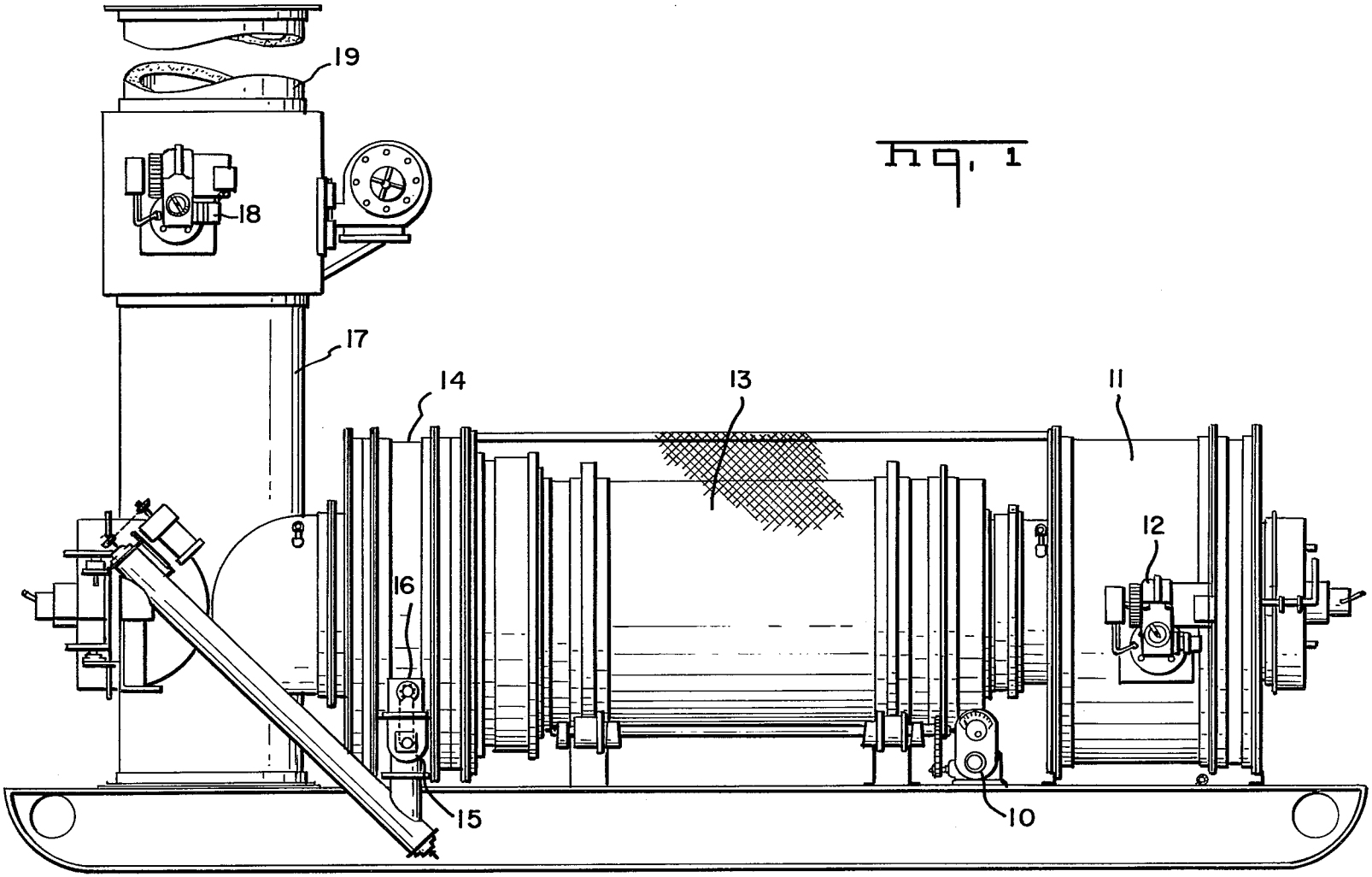
FIG. 1 shows the incinerator, or dryer, of this invention.

The embodiment illustrated in the figures is an incinerator for use with sewage sludge or the like. A primary combustion chamber 11 has a primary burner 12 and a sludge injection port (not shown). The sludge injection port protrudes on an angle from the primary combustion chamber into the rotating chamber 13 of the incinerator. The sludge travels through rotating chamber 13 which is driven by the variable speed drive 10 at approximately 1.5 revolutions per minute. Rotating speed is adjustable.

An ash removal chamber 14 at the other end of rotating chamber 13 includes screw conveyors 15 and 16 which remove the ash from chamber 14. The ash is separated from the combustion gases by an ash wheel in chamber 14 as will be subsequently described. The combustion gases pass into a transition chamber 17 and thence to a secondary burner 18 and a stack 19.

Figure 2:
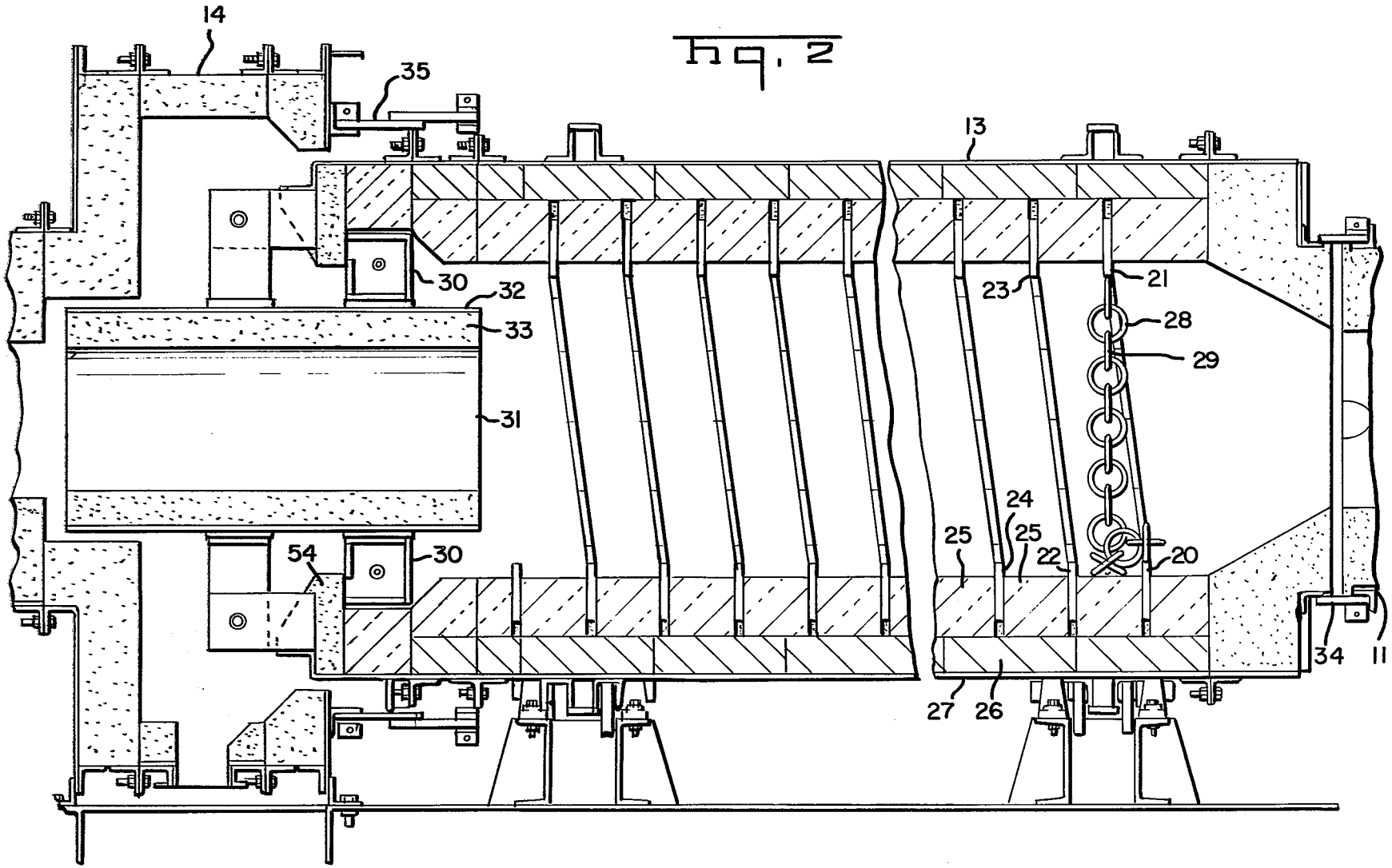
FIG. 2 is a section along the axis of rotation of the rotating chamber.

Referring to FIG. 2, the rotating chamber 13 is a horizontal drum which has a helical conveyor on the inside surface thereof for transporting material from the primary combustion chamber 11 to the ash removal chamber 14. The helical conveyor also serves the purpose of holding back the wet sludge from running the length of the rotating section. This helical conveyor includes a plurality of stainless steel flights 20–24, and others, embedded in the high temperature refractory 25. The drum includes insulation material 26 and a steel outer shell 27.

Heat scavenging devices are formed from steel rings 28, 29 and others joined together in a chain. This flexible chain is attached at its ends to the flights forming the helical conveyor. While only one heat scavenging device has been shown, a number of them are provided so that the chain preferably extends approximately ¾ of the length of the rotating chamber. When the chain is at the bottom of the drum, it rests in the wet sludge which clings to the chain. As the drum rotates, the chain slides or moves into a hanging position in the path of hot combustion gases which pass axially through the drum. The chain serves two functions. It scavenges heat from the combustion gases and this heat dries the wet sludge which clings to the chain. This chain also blocks the wet sludge from travel through the drum from right to left. When the wet sludge has been converted to ash, the ash lies in the bottom of the rotating drum where the helical conveyor carries it toward the ash removal chamber 14.

The ash wheel 30 rotates with the rotary chamber 13. An inner drum 31 includes a stainless steel liner 32 with a refractory lining 33. Hot combustion gases pass through the inner drum 31 to the stack while ash is removed by the ash wheel 30. All of the structure shown in FIG. 2 rotates with the exception of the primary combustion chamber 11 which has a seal 34 joining it to the rotating drum and the stationary ash removal chamber 14 which has a seal 35 joining it to the rotating drum.

Figure 4:
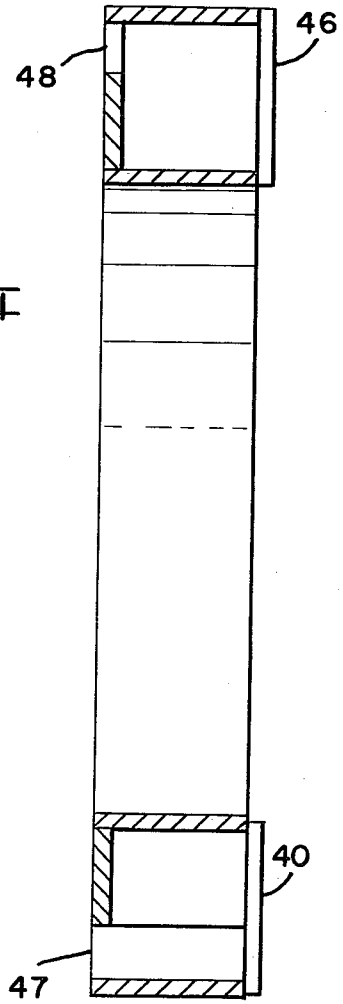
FIG. 4 is a section on the line 4—4 of FIG. 3.
Figure 7:
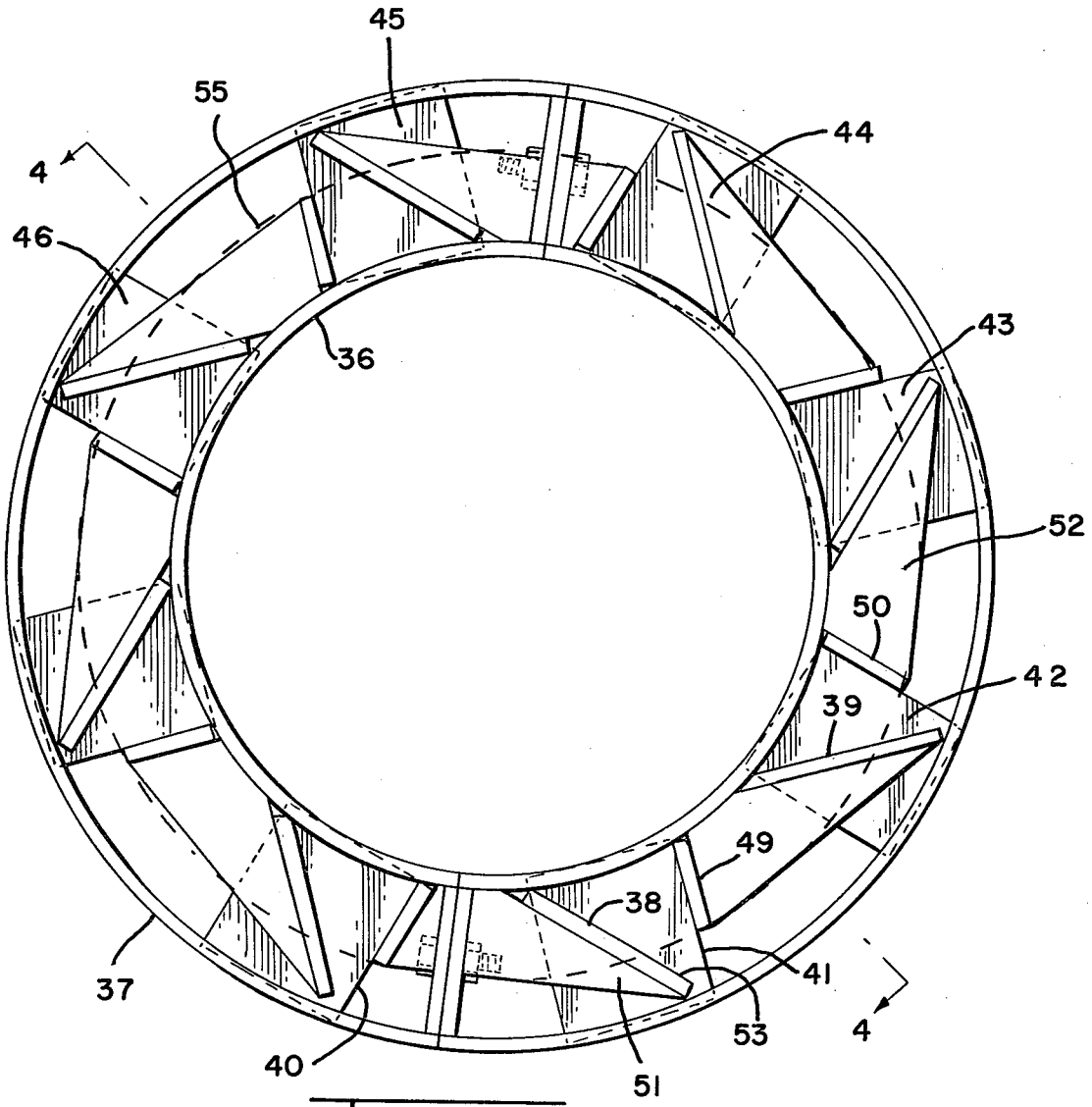
Figure 3A:
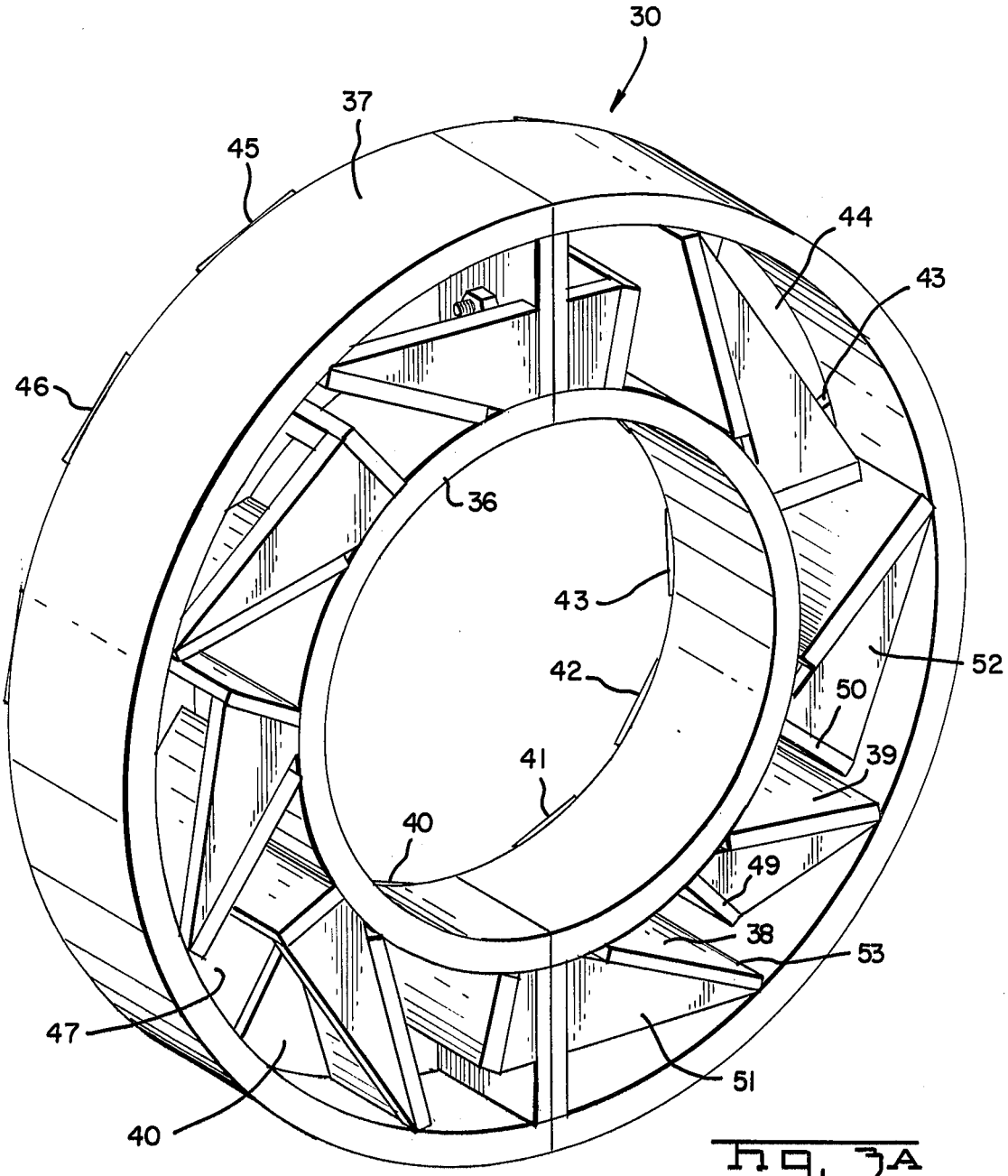
FIG. 3A is a perspective view of the other end of the ash wheel.

The ash wheel 30 is better shown in FIGS. 3, 3A and 4. The ash wheel includes an inner ring 36 and an outer ring 37. Ash holding plates 38, 39 and others scoop up the ash from the bottom of the rotating chamber. Baffle plates 40–46 and others are on sectors of the ash wheel which face the rotating chamber. There is an opening such as 47 and 48 (FIG. 4) behind each baffle plate on the other side of the ash wheel. Square plates such as 49, 50 and pie-shaped plates such as 51, 52 complete the construction of the ash wheel.

The ash enters the wheel between the sectors covered by the baffle plates 41 and 42. Initially, the ash is at the end of the ash holding plate, for example, the point 53. As this plate rotates toward the top, the ash starts to slide down toward the center of the wheel. It is not discharged from the wheel because the refractory 54 (FIG. 2) blocks the outer circumferential portion of the ash wheel 30 to the circumference indicated by the dashed line 55. As the ash holding plate continues rotation toward the top, the ash slides further down the plate until it is inside the circumferential dashed line 55. Then the refractory 54 no longer blocks its discharge. The ash falls from the wheel down over the inner drum 31 to the bottom of the ash removal chamber 14.

The screw conveyors 15 and 16 (FIG. 1) at the bottom of the ash removal chamber form an air lock. This prevents gases from the incinerator from escaping through any other path than through the stack 19. The ash wheel of this invention has important advantages because it separates the ash from the gases without having parts which move one with respect to the other in the hot part of the furnace. This is quite important for maintenance.

Figure 6:
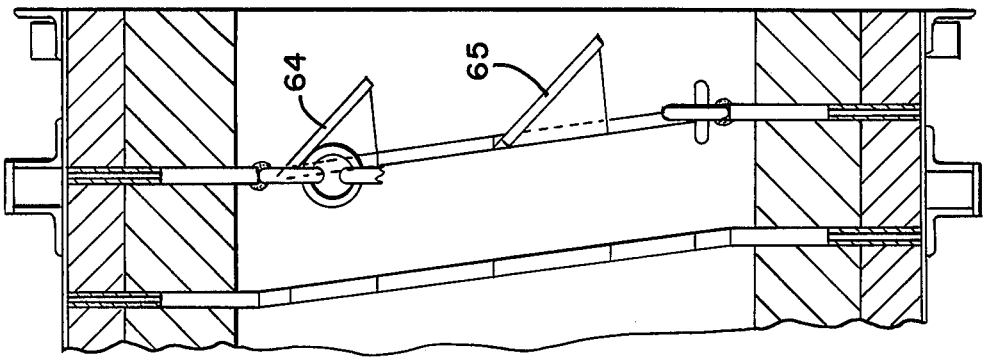
FIG. 6 is a portion of a section of the drum.
Figure 5:
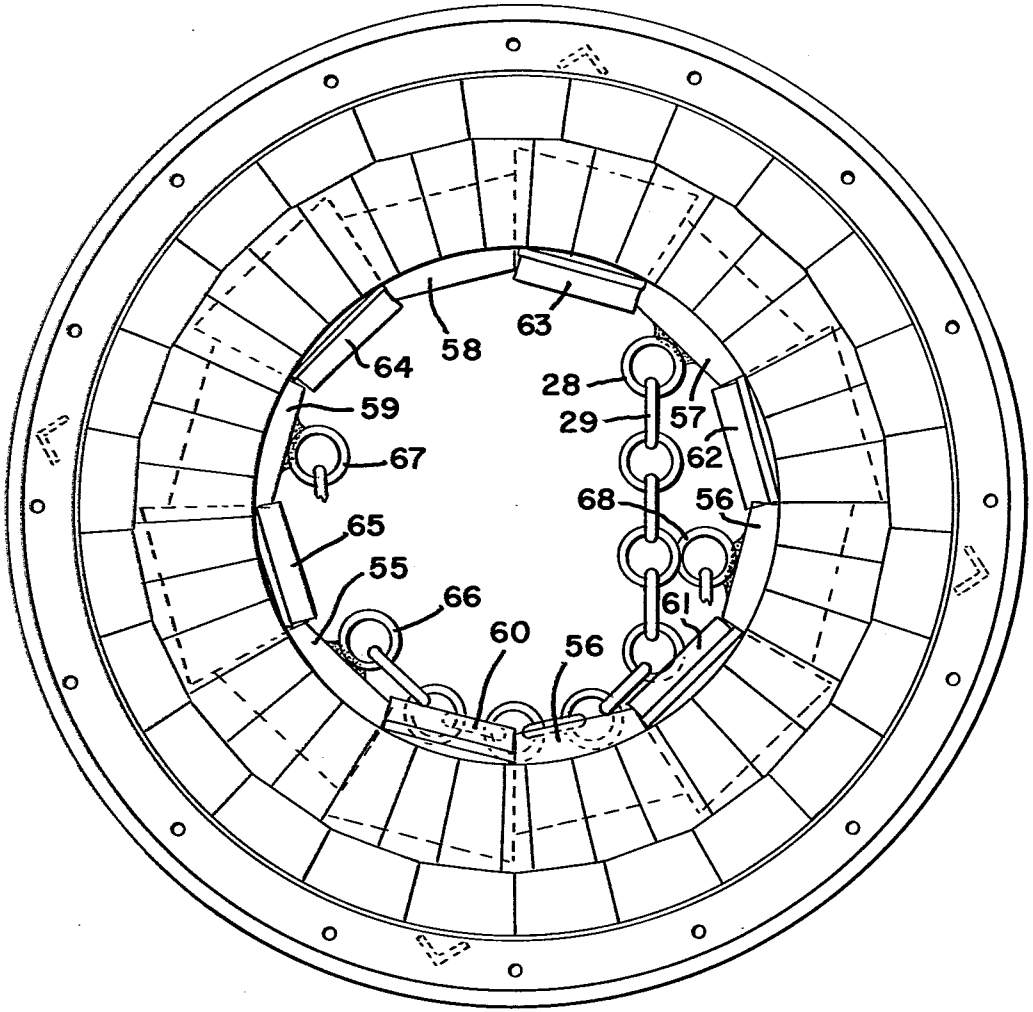
FIG. 5 shows the helical flights together with the chain.

FIG. 5 is an end view of the rotating chamber and FIG. 6 is the entry portion of a section of the drum. FIG. 5 shows the flights 55–59 which make up the helical conveyor. The first helix includes lifting flights 60–65 which are inclined outwardly toward the entry end of the rotating chamber. The lifting flights prevent sludge from flowing back into the area of the seal.

FIG. 5 also shows the chain including links 28, 29 and others. The link 28 is welded to the flight 57 and the link 66 at the other end of the chain is welded to the flight 55. The next chain has its end link 67 welded to the flight 59, and the link 68 at the other end is welded to the flight 56.

While a particular embodiment of the invention has been shown and described, various modifications are within the true spirit and scope of the invention. The appended claims are intended to cover all such modifications within the true spirit and scope of the invention.

What is claimed is:

1. Material treatment apparatus comprising:

a substantially horizontal rotating heated chamber, wet material to be dried being supplied to one end of said rotating chamber, a helical conveyor on the inside of said rotating chamber for transporting said material from one end of said chamber to the other end of said chamber, a plurality of elongated flexible metallic heat scavenging elements secured at the ends thereof to said helical conveyor so that each flexible element lies in contact with said wet material when it is in the bottom of said rotating chamber, and wherein said flexible elements move to a hanging position as said chamber rotates to a position wherein the flexible element is at the top thereof, and a primary burner fired by auxiliary fuel at said one end, gases from said primary burner blowing through the length of said drum and into contact with said flexible elements when they are disposed in a hanging position, the wet material clinging to said flexible elements having the moisture therein volatized by said gases, the remaining dry material being transported to the other end of said rotating chamber by said helical conveyor.

2. The apparatus recited in claim 1 wherein said flexible elements include steel rings formed together in a chain-like manner.

3. The apparatus recited in claim 1 wherein said ash wheel further comprises baffle plates disposed between said inner and outer rings on sectors of said ash wheel facing said rotating chamber, and wherein there are openings in said ash wheel on alternate sectors thereof facing away from said rotating chamber whereby dry material enters said ash wheel in open sectors, and is discharged from the openings in alternate sectors.

4. The apparatus recited in claim 3 further comprising an inner drum connected to rotate with said rotating chamber inside of said inner ring of said ash wheel, and a primary burner burning auxiliary fuel disposed at said one end of said rotating chamber, gases from said primary burner traveling through said rotating chamber and through said inner drum, whereby said ash wheel and said inner drum provide separation of gases from said dry material.

5. The apparatus recited in claim 1 wherein said helical conveyor includes a plurality of stainless steel flights disposed in a helical track around the inner surface of said rotating chamber.

6. The apparatus recited in claim 5 further comprising a plurality of lifting flights disposed in the helical conveyor around the inside of said rotating chamber at said one end, said lifting flights being inclined outwardly toward said one end of said rotating chamber to pick up wet material supplied to one end of said chamber.

7. Material treatment apparatus comprising:

a rotating heated chamber, wet material to be dried being supplied to one end of said rotating chamber, a helical conveyor on the inside of said rotating chamber for transporting said material from one end of said chamber to the other end of said chamber, a plurality of heat scavenging devices within said rotating chamber, said wet material clinging to said heat scavenging devices until the moisture therein is volatized and the remaining dry material is transported to the other end of said rotating chamber, an ash removal chamber disposed at the other end of said rotating chamber, an ash wheel including inner and outer rings disposed in said removal chamber and connected to rotate with said rotating chamber, said ash wheel transporting said dry material from said other end of said rotating chamber to said ash removal chamber, and a plurality of ash holding plates between said inner and outer rings for picking up said dry material at the bottom of the other end of said rotating chamber and for carrying it to the top thereof where it is discharged into said ash removal chamber.

8. The apparatus recited in claim 7 wherein said flexible elements include steel rings formed together in a chain-like manner.

9. The apparatus recited in claim 9 wherein said helical conveyor includes a plurality of stainless steel flights disposed in a helical track around the inner surface of said rotating chamber.

10. The apparatus recited in claim 9 further comprising a plurality of lifting flights disposed in the helical conveyor around the inside of said rotating chamber at said one end, said lifting flights being inclined outwardly toward said one end of said rotating chamber to pick up wet material supplied to one end of said chamber.

* * * * *